United States Patent [19]

Schmits et al.

[11] Patent Number: 4,762,489

[45] Date of Patent: Aug. 9, 1988

[54] COOLING APPARATUS

[75] Inventors: Heinz-Herbert Schmits, Rheda-Wiedenbruck; Hermann Niemerg, Ennigerloh, both of Fed. Rep. of Germany

[73] Assignee: Krupp Polysius AG, Beckum, Fed. Rep. of Germany

[21] Appl. No.: 37,206

[22] Filed: Apr. 10, 1987

[30] Foreign Application Priority Data

May 16, 1986 [DE] Fed. Rep. of Germany ..... 3616630

[51] Int. Cl.[4] ..... F27D 15/02

[52] U.S. Cl. ..... 432/77; 432/78; 432/83; 110/283; 110/300

[58] Field of Search ..... 432/233, 238, 77, 78, 432/83, 84; 110/291, 300, 283; 98/41.3

[56] References Cited

U.S. PATENT DOCUMENTS

| | | | |
|---|---|---|---|
| 1,338,694 | 5/1920 | Peebles | 110/300 |
| 2,255,681 | 9/1941 | Santer et al. | 110/283 |
| 2,528,292 | 10/1950 | Arnold et al. | 110/291 |
| 3,441,082 | 4/1969 | Fragnito et al. | 98/41.3 |
| 3,824,068 | 7/1974 | Kobayashi et al. | 432/83 |
| 3,831,291 | 8/1974 | Kayatz | 432/77 |
| 4,170,183 | 10/1979 | Cross | 110/291 |
| 4,280,418 | 7/1981 | Erhard | 432/78 |
| 4,426,918 | 1/1984 | Lambert | 98/41.3 |
| 4,452,152 | 6/1984 | John et al. | 110/291 |
| 4,510,873 | 4/1985 | Shigaki | 110/283 |
| 4,512,266 | 4/1985 | Shigaki | 110/283 |
| 4,519,539 | 5/1985 | Bussjagar et al. | 98/41.3 |
| 4,624,636 | 11/1986 | Willis | 432/78 |

*Primary Examiner*—Henry C. Yuen

*Attorney, Agent, or Firm*—Learman & McCulloch

[57] ABSTRACT

The cooling apparatus which is preferably constructed in the form of a grate cooler contains in its material inlet portion a material transfer arrangement with at least two rows lying behind one another of transversely extending air boxes which can be supplied with air and have upper surfaces with air holes. The clear opening width of these air holes (area for the air to pass through) is adjustable, so that all air boxes can be supplied independently of one another with adjustable quantities of air. In this way the streams of cooling air can be adapted to differing local ranges of grain sizes of the clinker on the material transfer arrangement.

14 Claims, 5 Drawing Sheets

COOLING APPARATUS

The invention relates to cooling apparatus for essentially granular material precipitated from a kiln to claim 1.

BACKGROUND OF THE INVENTION

Cooling apparatus of this type includes in particular so-called travelling grate coolers, thrust grate coolers and the like which are used in order for material which has been previously burnt in a kiln, particularly cement clinker and other mineral materials, to be drastically cooled immediately thereafter with the aid of cooling air or cooling gases. The mostly red-hot material coming out of the kiln should be both cooled and well distributed in the material inlet portion so that it can then be passed in an even distribution to the cooling grate on which the main part of the cooling is carried out while the material is being transported.

If for example, one considers the cooling of cement clinker which has previously been burnt in a mixture of different grain sizes in a rotary kiln, then care should be taken to ensure that when the hot cement clinker is discharged from the kiln into the cooling apparatus which is arranged immediately after it a separation of the essentially granular clinker takes place in such a way that a quantity of predominantly coarse material is deposited on one side of the cooler and a quantity of predominantly fine material is deposited on the other side of the cooler.

This results in the formation of layers of cooled material with differing air permeability over the breadth of the cooling apparatus. Since air always seeks the path of least resistance, the greater proportion of the quantity of cooling air introduced in the cooler inlet portion or the material transfer arrangement thereof will flow through the coarse material and only a small proportion of the cooling air which has been introduced will flow through the fine material, so that cooling of the latter at least in the material inlet portion of the cooling apparatus is quite unsatisfactory or even does not occur at all in places. Attention should also be paid to the fact that in cooling apparatus with cooling grates, particularly in the case of so-called thrust grate coolers but also to some extent in the case of so-called travelling grate coolers, there is a danger of a so-called "mushroom formation" (mushroon-like buildup or growth of hot material on the material transfer surface) in the inlet portion.

Attempts have already been made to reduce this mushroom formation by having the upper surface of the material transfer arrangement which comes into contact with the material constructed with water-cooled plates, but this has the disadvantage that it reduces the required degree of recovery. Another proposal which has already been made is to provide the material transfer arrangement of the material inlet portion with an aerating base in which the flow resistance for the cooling air is greater than in the cooled material embankment: however, even this only has the effect of somewhat reducing the aforesaid problems.

Furthermore, it is also already known to use mechanical discharge means which can be moved to and fro in order, in particular, to remove larger lumps of material as quickly as possible from the impact region of the material transfer arrangement in order to reduce the danger of mushroom formation. Here too, however, it has been shown that the distribution of cooling air is still most unsatisfactory and even when the cooling air is introduced in pulses the occurrence of so-called "red rivers", i.e. essentially red-hot uncooled streams of material, must be expected.

SUMMARY OF THE INVENTION

The object of the invention, therefore, is to improve cooling apparatus of the type discussed above to the extent that even with comparatively well separated material precipitated from the kiln a very even flow of cooling air through the sections of material with differing grain sizes is facilitated, thus facilitating a very even cooling effect over all the material in the material inlet portion of the apparatus as well as an even distribution of the previously cooled material on the cooling grate.

In the construction according to the invention the clear width of opening of the air holes in the aerating bases of the air boxes can be adjusted so that the air permeability can be altered as required, and thus the compensating resistance of the cooling air to be blown through the layers of material can be kept constant so that the blowing of air through the material can be better adapted in energy terms to the kiln capacity, the range of grain sizes and the grain size distribution of the material to be cooled. That is to say the necessary quantity of cooling air can be blown through with minimal pressure loss and comparatively low construction costs.

Also since all the air boxes can be supplied independently of each other with adjustable quantities of air, the upper surface of the material transfer arrangement in the material inlet portion of the apparatus can be divided particularly advantageously into a plurality of individual air supply zones so that even hot material which is well separated when it falls from the kiln onto the material transfer arrangement can be cooled extremely evenly. In this way the undesirable mushroom formations and developments of "red rivers" can also be avoided or at least reduced to a minimum in the material inlet portion of the apparatus.

THE DRAWINGS

The invention will be described in greater detail below with the aid of the one embodiment which is illustrated in the drawings. The drawings have been kept largely schematic and in them:

DETAILED DESCRIPTION

Figure 1:
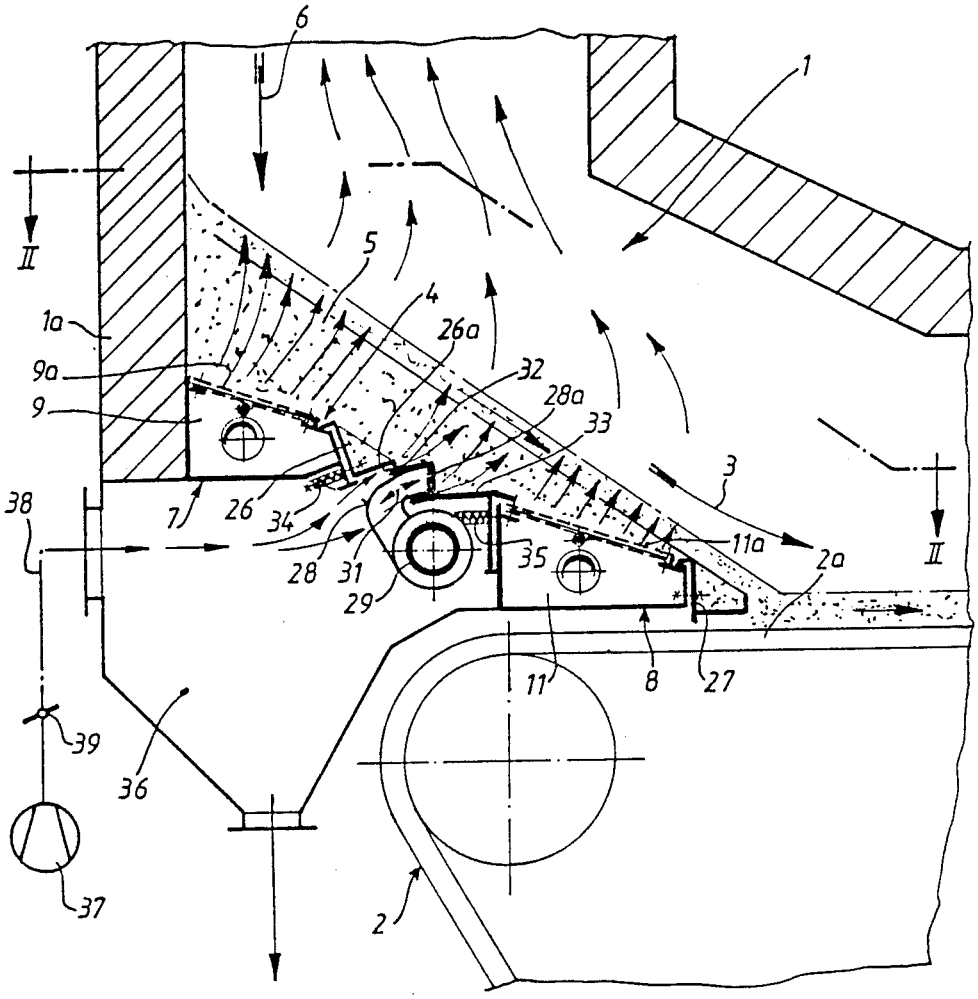
FIG. 1 shows a partial longitudinal sectional view (section line I—I in FIG. 2) through the cooling apparatus in the region of its material inlet portion.
Figure 2:
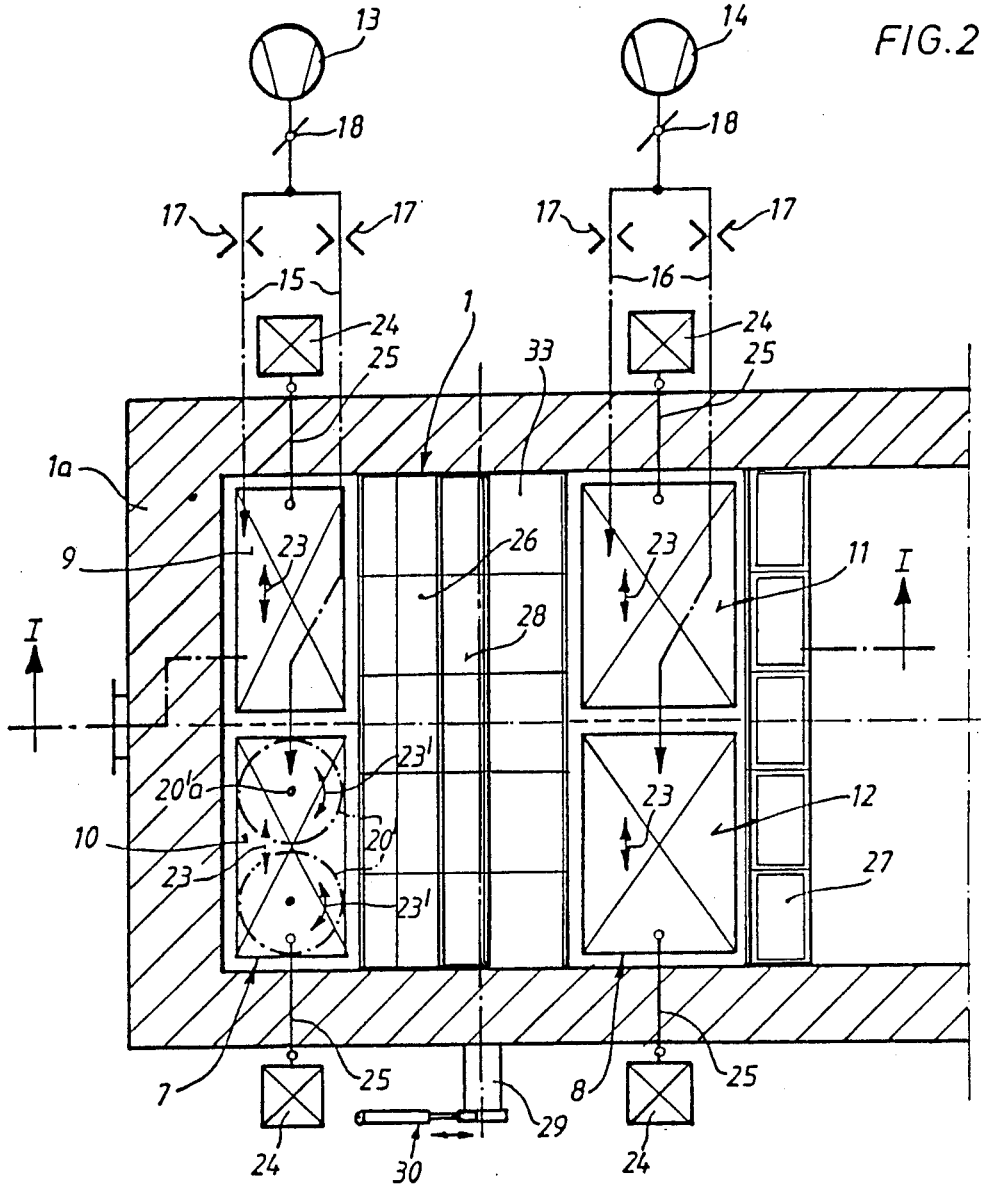
FIG. 2 shows a plan view (approximately along the lines II—II in FIG. 1) with additional arrangements shown in very schematic form.

Since the present invention relates principally to an improvement in the material inlet portion of the cooling apparatus, only the material inlet portion 1 of this cooling apparatus and the supply end 2 of a cooling grate which is constructed for example as a travelling grate 2 are shown in FIGS. 1 and 2.

The material inlet portion 1 is arranged before the supply end 2a of the cooling grate —when viewed in the material flow direction according to the arrow 3—and contains a material transfer arrangement 4 which is inclined towards the supply end 2a of the cooling grate and extends from the rear wall 1a of the material inlet portion to just above the upper section of the travelling grate 2. This material transfer arrangement receives a layered embankment of the hot material 5 to be cooled (FIG. 1) which falls approximately as shown by the arrow 6 out of the outlet end of a kiln, for example a rotary kiln, which is known and is not shown in greater detail here and spreads over the material transfer arrangement 4.

In the embodiment illustrated in FIGS. 1 and 2 the material transfer arrangement 4 contains two rows of air boxes 7 and 8 lying one behind the other when viewed in the material flow direction (arrow 3). Each row of air boxes 7 or 8 has, as shown in particular in FIG. 2, two air boxes 9, 10 or 11, 12 which lie adjacent to one another at right angles to the material inlet portion. These boxes are constructed on their material-bearing upper surfaces as aerating bases. See 9a and 11a in FIG. 1, and are provided with air holes, as will be explained in greater detail below. It goes without saying that depending upon the particular breadth and length of the material inlet portion of the cooling apparatus more than two such rows of air boxes or more than two air boxes in a row can be provided.

In this illustrating embodiment the two air boxes 9 and 10 of the row of air boxes 7, which is to the rear when viewed in the material flow direction (arrow 3), are connected to one common cooling air blower 13 and the two air boxes 11, 12 of the front row of air boxes 8 are connected to a common cooling air blower 14 via similar cooling air supply pipes 15 and 16 respectively in which shutters 17 which are adjustable in a manner which is known and adjustable throttle valves 18 are provided in such a way that an individually adjustable quantity of air can be delivered to each air box 9 to 12 with the appropriate compensating resistance.

Figure 3:
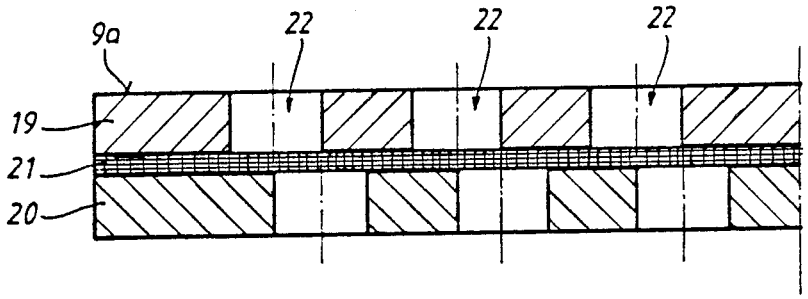
FIG. 3 shows a partial cross-sectional view through the aerating base of an air box.

The construction of the aerating base of each air box 9 to 12 is of particular importance. Reference is also made to FIG. 3 for explanation of the construction of these aerating bases. It should be assumed that in FIG. 3 a partial sectional view through the aerating base 9a of the air box 9 is shown; however, it should be expressly emphasized that the aerating bases of all the other air boxes 10 to 12 (or also further air boxes) can be of similar construction.

The aerating base 9a has two perforated sheets lying one above the other, namely an upper perforated sheet 19 and a lower perforated sheet 20, as well as a wire mesh 21 which is arranged between them and is preferably a multilayer rolled wire mesh. The two perforated sheets 19, 20 and the interposed wire mesh 21 are arranged closely one above another. As can also be seen from FIG. 4, both perforated sheets 19, 20 have the same pattern of holes with the same size and distribution of holes. Moreover the lower perforated sheet 20 is preferably movable in a parallel direction with respect to the upper perforated sheet 21 so that the air holes 22 of the aerating base 9a which are formed in this way can have their clear width of opening (for example the width of opening 22a indicated in FIG. 4) adjusted to a certain extent like a shutter, as will be explained in greater detail below.

The interposition of the wire mesh 21 on the one hand produces the compensating resistance which is necessary in this aerating base for the even distribution of the cooling air and on the other hand prevents the material to be cooled from falling into the appertaining air box, e.g. 9.

Figure 4:
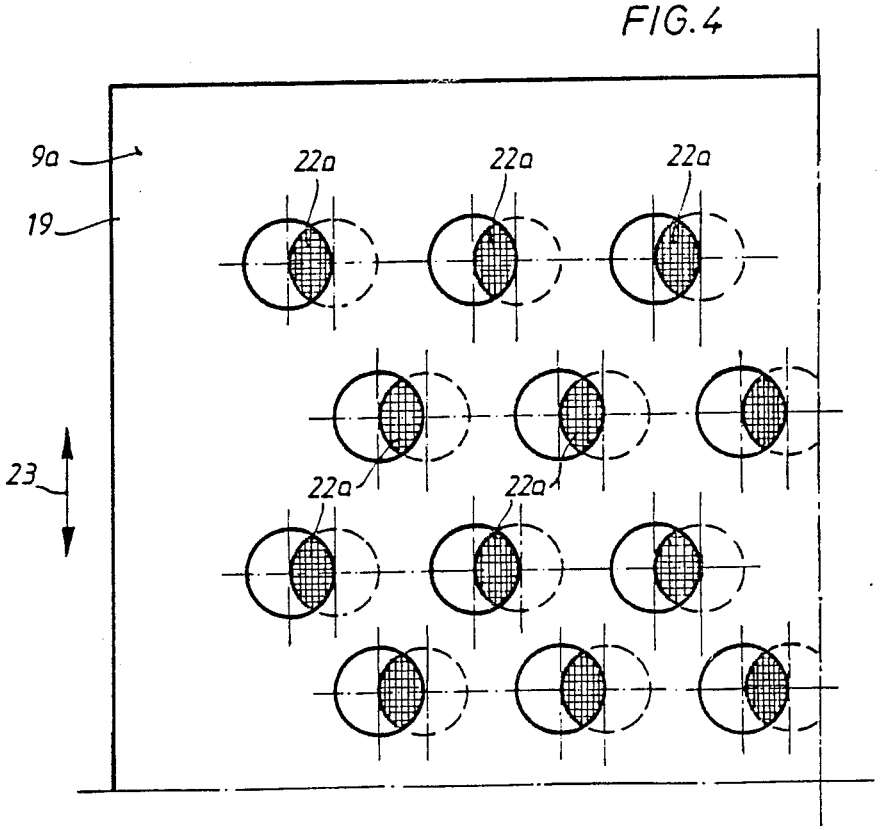
FIGS. 4 to 7 show partial plan views of the aerating base according to FIG. 3 at different settings of the air holes.
Figure 5:
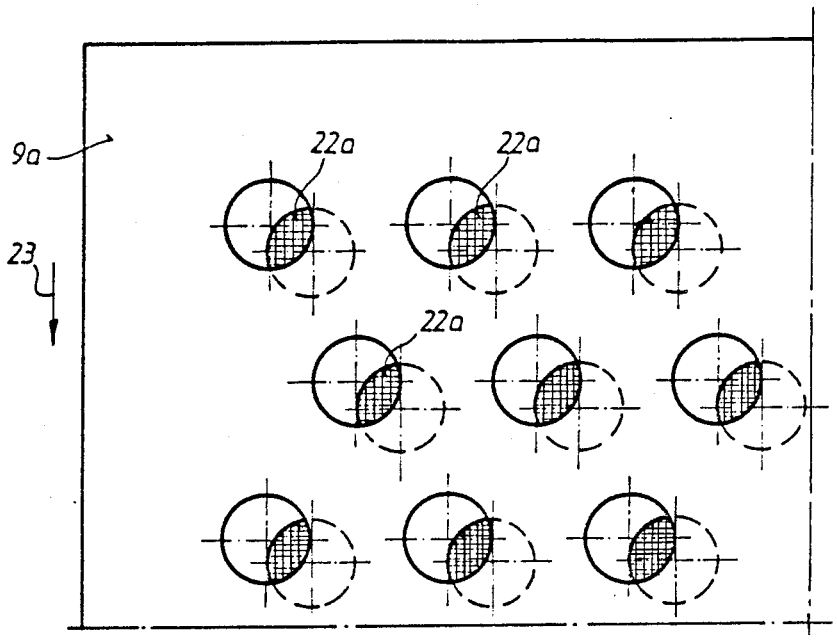
Figure 6:
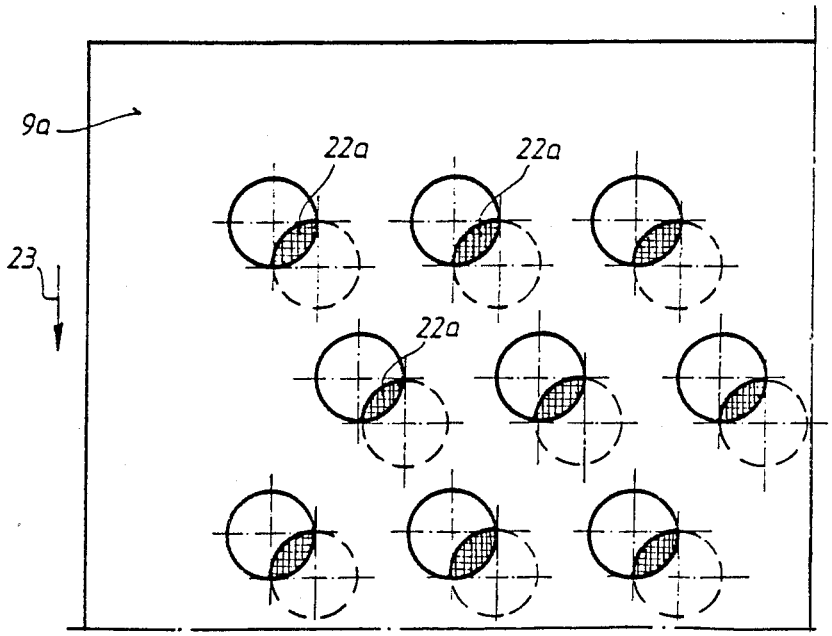
Figure 7:
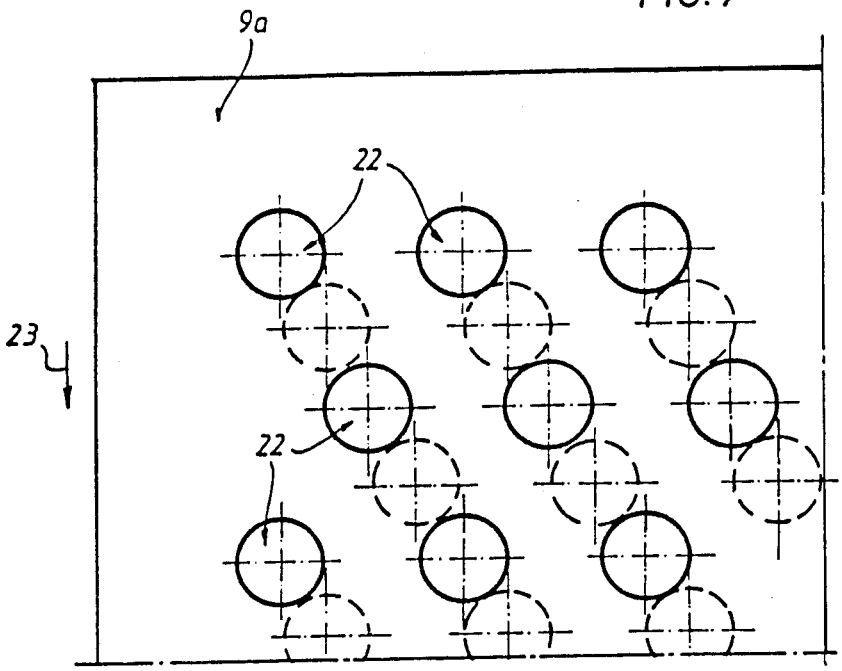

It is also shown in FIGS. 3 and 4 that the spacing of the holes in the upper and lower perforated sheets 19 and 20 respectively of the aerating base 9a is such that they are staggered with respect to one another by approximately half a hole diameter (i.e. in the starting position of the two perforated sheets 19, 20 with respect to one another). This superposition results in approximately almond-shaped areas for the air to flow through or clear widths of opening 22a for the individual holes 22 as shown in FIG. 4. If it is assumed that the upper perforated sheet 19 (and preferably also the wire mesh 21 which lies immediately beneath it) is fixed on the appertaining air box, e.g. 9, so as to be rigid or stationary and the lower perforated sheet 20 can be moved parallel with respect to the upper perforated sheet 19 in the direction of the double arrow 23 (FIG. 4), then Figure 4 shows the aerating base 9a with its area for the air to stream out opened to the maximum extent, i.e. all the air holes 22 are set at their greatest clear width of opening 22a (with the greatest area for the air to flow through). A gradual parallel displacement of the lower perforated sheet 22 of the aerating base 9a in one direction of the arrow 23, i.e. parallel to the longer axis of the almond shape of the opening surface, has the effect that the clear width of opening 22a and with it the area for the air to flow through of all the air holes 22 is gradually reduced in accordance with the illustrations in FIGS. 5 and 6 so that at a setting according to FIG. 7 the air holes 22 can be completely closed.

Figure 8:
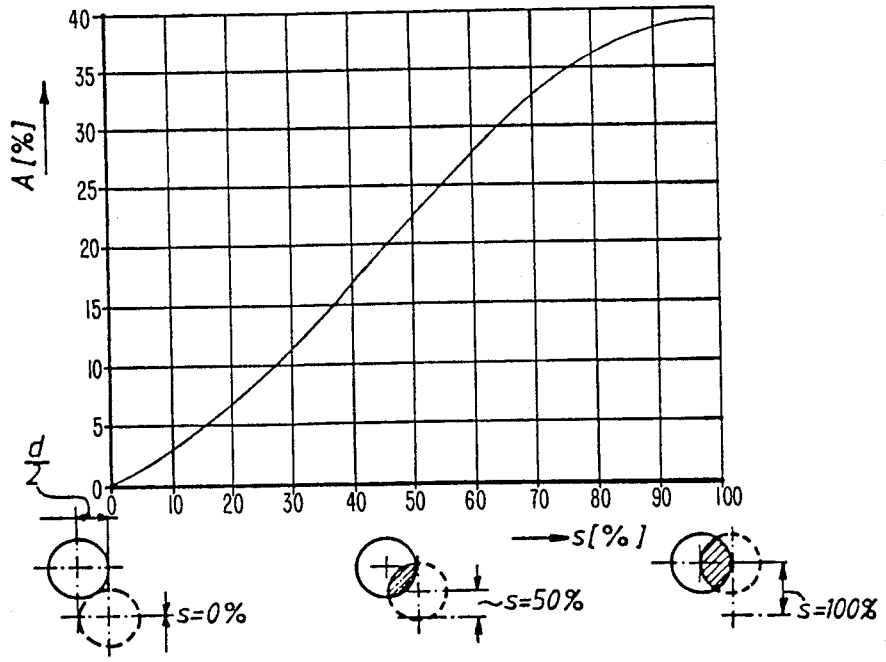
FIG. 8 shows a diagram of the different possible settings of the width of opening of the air holes.

The diagram in FIG. 8 illustrates how the open hole area A (in %) of an aerating base 9a can alter as a function of the displacement path s (in %) according to the illustrations in FIGS. 4 to 7. The maximum displacement positions $\cong 100\%$ correspond to a maximum open hole surface or maximum clear width of opening $A = 0.39\%$ (according to the representation in FIG. 4).

Suitable displacement drives 24 which are connected by rods 25 to the appertaining lower perforated sheets 20 (cf. FIG. 2) can be associated with each air box 9 to 12 at an appropriate point for the parallel displacement referred to above of the lower perforated sheet 20 in the direction of the double arrow 23 in the aerating base (e.g. 9a) of each air box 9 to 12.

Whereas in the foregoing explanation the lower perforated sheet 20 of each aerating base is capable of parallel displacement essentially in a straight line (arrow 23), the adjustability of the clear widths of opening of the air holes 22 can be achieved with the same effect but also by a circular displacement of the lower perforated sheets which can for example be constructed in the shape of a circular disc. Such a possibility is indicated by dash-dot lines in FIG. 2 in the air box 10. According to this illustration perforated sheets 20' which are approximately in the shape of a circular disc, and which are rotatable in the direction of the double arrows 23' about a centrally arranged axis of rotation 20'a which extends vertically with respect to the plane of the aerating base can be provided as the lower perforated sheets, and are thus equally capable of parallel displacement. For this movement similar drives to the displacement drive 24 can be provided which engage for example eccentrically on these adjustable perforated sheets via connecting rods.

The possibility of circular displacement of the lower perforated plates as described above can make localised alterations to the porosity, i.e. the open hole area for the passage of the cooling air, whereby the width of opening of the individual air holes can be of differing magnitude depending upon the distance from the axis of rotation and the angle of rotation. By contrast, in the case of displacement only in a straight line, approximately in accordance with the arrow 23 in FIG. 2, the said porosity is altered uniformly over the whole aerating surface of an aerating base. The wedges between adjacent round perforated sheets resulting from this circular displacement can be supplied with air individually or not supplied with air at all as required.

In each of the embodiments of the lower perforated sheet or sheets of the aerating bases described above it is generally necessary that these adjustable perforated sheets be located in a dust-free space.

Further advantageous embodiments and further developments of this cooling apparatus, particularly the material transfer arrangement 4, are illustrated in FIGS. 1 and 2.

As can be seen particularly in FIG. 1, wear protection boxes 25 and 27 which retain material are fixed at least behind the aerating bases, when viewed in the material flow direction (arrow 3). That is to say at the rear end of each air box 9 to 12, they extend over the entire breadth of the material inlet portion 1 and can be of continuous or divided construction.

At least one thrust bar in the form of a rotating ram 28 which can be moved to and fro approximately in the material flow direction (arrow 3) and can extend over a part of the breadth of the material inlet portion 1 or preferably over its entire breadth, is provided in the region between the wear protection boxes 26 of the rear row of air boxes and the aerating bases of the front row of air boxes 8 between each pair of rows of air boxes following one another in the material flow direction (arrow 3). That is to say between the rows 7 and 8 in this example. The rotating ram 28 is mounted on a rotary shaft so as to be fixed against rotation and is connected by this rotary shaft 29 to a pivot drive 30 which can be moved to and fro. This pivot drive 30 is preferably arranged outside the housing of the material inlet portion 1 and, as indicated in FIG. 2, can consist in a known manner of a cylinder-piston unit which is operated by a pressure medium and acts on a lever of the rotary shaft 29 or through a crank drive. In addition, this pivot drive 30 can be driven so that it moves to and from continuously or only intermittently in case of need. It can also be advantageous if required for the number of strokes of this pivot drive 30 to be variable.

The rotating ram 28 can be pivoted to and from in the manner described above in the direction of the double arrow 31 so that its bar-like leading edge **28*a* can act on the hot embankment of material lying on the material transfer arrangement 4 in such a way that caking together is avoided and any incrustations can be broken up. At the same time the larger lumps of material which sink through the material embankment and from which the mushroom formation referred to earlier could otherwise result are transported on. In this way an extremely even flow of air through the embankment of material located on the material transfer arrangement 4** is ensured.

As can be seen in FIG. 1, the rotating ram 28 passes in particular with the region of its bar-like leading edge **28*a* through a slot 32 which is constructed at right angles to the material inlet portion 1 in the material transfer arrangement 4 and is defined on the one hand by the wear protection boxes 26 of the rear row of air boxes 7 and on the other hand by essentially fixed cast cover plates 33 on the rear edges of the front row of air boxes 8. The undersides 26*a* of the wear protection boxes 26 thus also form a sort of cover plate for the rear edge of the slot 32. The wear protection boxes 26 of the rear row of air boxes 7 and the cover plates 33 can be springmounted on the appertaining air boxes 9, 10, and 11, 12 as indicated by springs 34 and 35 in FIG. 1**. In this way jamming of the rotating ram can be avoided even in unfavourable conditions.

A further separate air box 36 which can be supplied with cooling air via a blower 37 and a cooling air supply pipe 38 with a throttle valve 39 arranged in it is arranged at least in the region below the rotating ram 28. This separate air box 36 is so constructed and arranged that the delivered cooling air can flow against the rotating ram 28 and through the slot 32. A constant quantity of cooling air is preferably delivered continuously to the air box 36 so that the slot 32 for the rotating ram 28 can always be kept clear. At the same time cooling of the rotating ram and the rotary shaft 29 can be achieved. The cooling air can flow through the slot 32 at a speeds of approximately 20 to 80 m/s, preferably 30 to 60 m/s.

To summarize, therefore, it can be said that the proposed construction of the cooling apparatus, particularly the material transfer arrangement of the material inlet portion, offers the possibility of adapting the cooling air stream to the local range of grain sizes of the clinker using means of comparatively simple design. Thus the clinker can be cooled evenly, so that a high degree of thermal efficiency is achieved. In addition, the necessary quantity of cooling air can be accurately set and regulated, which also results in savings of electrical energy.

What is claimed is:

1. In cooling apparatus for granular material precipitated from a kiln having a material discharge end, said apparatus including a cooling grate having an inlet end, and material transfer means bridging the discharge end of said kiln and the inlet end of said grate for transferring material along a path from said kiln to said cooling grate, said material transfer means being inclined downwardly towards said grate and having at least two rows of air boxes below and extending across said path, each of said air boxes being connected to at least one cooling air blower, the improvement wherein each of said rows of air boxes has an aerating base comprising overlying sheets, each of said sheets containing multiple perforations, means for moving the sheets of each of said boxes relative to one another between positions in which the respective perforations are in and out of registration with one another thereby to adjust the amount of air that may flow through said perforations, and means for adjusting the air supplied to each of said boxes, thereby enabling an optimum flow of cooling air through said perforations to be achieved.

2. Cooling apparatus according to claim 1 including a wire mesh interposed between each pair of perforated sheets, said perforated sheets each having the same pattern of perforations and the same size and distribution of perforations.

3. Cooling apparatus according to claim 2 wherein said wire mesh is composed of multiple layers.

4. Cooling apparatus according to claim 1 wherein the perforations in said sheets are circular, the spacing of said perforations in the upper and lower sheets of each box being staggered with respect to one another by approximately half a perforation diameter.

5. Cooling apparatus according to claim 1 wherein said sheets lie in parallel planes and are movable relative to one another in their respective planes.

6. Cooling apparatus according to claim 1 wherein one of said sheets is rotatable about an axis.

7. Cooling apparatus according to claim 1 including wear protection members downstream of each aerating base, such wear protection members being operable to contain a quantity of said material therein.

8. Cooling apparatus according to claim 1 including at least one thrust bar between adjacent rows of boxes, and means mounting such bar for movements to and fro along said path.

9. Cooling apparatus according to claim 8 wherein said thrust bar comprises a rockable ram.

10. Cooling apparatus according to claim 9 including means for controlling the rate of rocking movements of said ram.

11. Cooling apparatus according to claim 9 including cover plates mounted on said air boxes immediately upstream and downstream of said ram.

12. Cooling apparatus according to claim 11 including spring means mounting said cover plates for yielding movement relative to the respective air boxes.

13. Cooling apparatus according to claim 9 including a separate air box at a level below said ram for directing an air stream towards said ram, and means for supplying cooling air to said separate air box.

14. Cooling apparatus according to claim 13 including an adjustable shutter and an adjustable throttle valve connecting said air boxes to the respective cooling air blower.

* * * * *